US008731442B2

(12) United States Patent
Kato et al.

(10) Patent No.: US 8,731,442 B2
(45) Date of Patent: May 20, 2014

(54) IMAGE FORMING APPARATUS

(75) Inventors: Shuichi Kato, Nagoya (JP); Seiichi Senda, Anjo (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 141 days.

(21) Appl. No.: 13/362,874

(22) Filed: Jan. 31, 2012

(65) Prior Publication Data

US 2012/0237263 A1 Sep. 20, 2012

(30) Foreign Application Priority Data

Mar. 16, 2011 (JP) ..... 2011-057466

(51) Int. Cl.
*G03G 15/01* (2006.01)

(52) U.S. Cl.
USPC ..... 399/223; 399/222

(58) Field of Classification Search
USPC ..... 399/223
See application file for complete search history.

(56) References Cited

U.S. PATENT DOCUMENTS

| | | | | |
|---|---|---|---|---|
| 5,066,989 | A * | 11/1991 | Yamamoto | 430/45.32 |
| 6,029,033 | A | 2/2000 | Kawasaki | |
| 2009/0060584 | A1 | 3/2009 | Endou | |

FOREIGN PATENT DOCUMENTS

| | | | |
|---|---|---|---|
| JP | H06-011941 | A | 1/1994 |
| JP | H11-186782 | A | 7/1999 |
| JP | H11-249452 | A | 9/1999 |
| JP | 2000-098694 | A | 4/2000 |
| JP | 2004-170654 | A | 6/2004 |
| JP | 2008-257114 | A | 10/2008 |

* cited by examiner

*Primary Examiner* — Clayton E Laballe
*Assistant Examiner* — Jas Sanghera
(74) *Attorney, Agent, or Firm* — Baker Botts L.L.P.

(57) ABSTRACT

An image forming apparatus is provided, which is configured to form an image with developer of a plurality of colors on a sheet-type recording medium by a non-magnetic single component developing method. The image forming apparatus includes a first color developing unit which is configured to perform developing of a first color by a jumping developing method, and a second color developing unit which is configured to perform developing of the second color by a contact developing method.

9 Claims, 6 Drawing Sheets

IMAGE FORMING APPARATUS

CROSS-REFERENCE TO RELATED APPLICATION

This application claims priority from Japanese Patent Application No. 2011-057466, filed on Mar. 16, 2011, the entire subject matter of which is incorporated herein by reference.

TECHNICAL FIELD

Aspects of the present invention relate to an image forming apparatus which is configured to form an image with developer (toner) of a plurality of colors on a sheet-type recording medium by a non-magnetic single component developing method.

BACKGROUND

For example, JP H.11-249452 A describes this kind of image forming apparatus. This image forming apparatus includes a plurality of developing units of respective colors aligned in parallel with each other. When forming a multicolor image, developing operations are sequentially performed by the plurality of developing units.

In this apparatus, after new toner is supplied or after a toner cartridge being used is replaced with a new toner cartridge, an image quality may be deteriorated as using time elapses (as the number of image formation sheets is increased). The deterioration of an image quality over time is mainly caused due to deterioration of toner in a black developing unit which is most frequently used, introduction of foreign substances such as paper dusts into a developing unit in which the developing operation is first performed, and the like.

SUMMARY

According to an illustrative embodiment of the present invention, there is provided an image forming apparatus configured to form an image with developer of a plurality of colors on a sheet-type recording medium by a non-magnetic single component developing method. The image forming apparatus includes a first color developing unit which is configured to perform developing of a first color by a jumping developing method before performing developing of a second color, and a second color developing unit which is configured to perform developing of the second color by a contact developing method after performing the developing of the first color by the first color developing unit.

According to another illustrative embodiment of the present invention, there is provided an image forming apparatus configured to form an image with developer of a plurality of colors on a sheet-type recording medium by a non-magnetic single component developing method. The image forming apparatus includes a first color developing unit which is configured to perform developing of black by a jumping developing method, and a second color developing unit which is configured to perform developing of a second color by a contact developing method.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, an illustrative embodiment of the invention will be described with reference to the drawings.

<Overall Configuration of Color Laser Printer>

Figure 1:
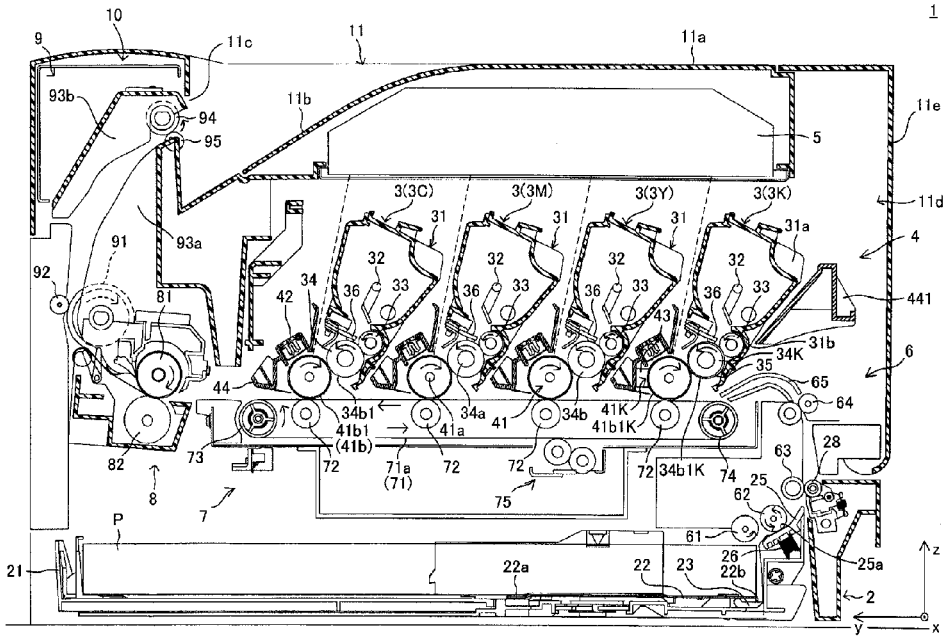
FIG. 1 is a side sectional view showing a schematic configuration of a color laser printer according to an illustrative embodiment of the present invention.

FIG. 1 is a side sectional view showing a schematic configuration of a color laser printer 1 according to an illustrative embodiment of the present invention. In the below, the right side of FIG. 1 (−y direction in FIG. 1) is referred to as the 'front side' of the color laser printer 1 and the left side of FIG. 1 (+y direction in FIG. 1) is referred to as the 'rear side' of the color laser printer 1. Also, the upper-lower direction of FIG. 1 (±z direction in FIG. 1) is referred to as the 'height direction' or 'upper-lower direction' of the color laser printer 1 and the left-right direction (±y direction in FIG. 1) of FIG. 1 is referred to as the 'front-rear direction' of the color laser printer. Also, a direction perpendicular to the sheet of FIG. 1 (±x direction in FIG. 1) is referred to as the 'width direction' of the color laser printer 1.

The color laser printer 1 is configured to form an image by toner (dry toner of non-magnetic single component) of a plurality of colors on a sheet P which is a sheet-type recording medium. Specifically, the color laser printer 1 of this illustrative embodiment has a sheet feeding tray 2, developing units 3 (black developing unit 3K, yellow developing unit 3Y, magenta developing unit 3M and cyan developing unit 3C), a drum unit 4, an exposure unit 5, a sheet conveyance unit 6, a transfer unit 7, a fixing unit 8 and a sheet discharge unit 9.

A main body frame 10 configuring a main body part of the color laser printer 1 is covered by a body casing 11 which is a box-shaped member made of resin. A sheet discharge tray 11*b* is formed on an upper surface 11*a* of the body casing 11. The sheet discharge tray 11*b* is provided to receive the sheet P discharged from a sheet discharge port 11*c* which is formed at an upper part of a rear side of the body casing 11. A front side of the body casing 11 is formed with a front opening 11*d*. The front opening 11*d* is provided such that a maintenance operation can be performed for the inside of the color laser printer 1 by opening a front cover 11*e* to the front side. The front cover 11*e* is configured to be opened and closed along the front-rear direction (y direction in FIG. 1) about a lower end portion thereof.

<<Sheet Feeding Tray>>

The sheet feeding tray 2 configured to stack and accommodate therein the sheets P is detachably mounted to a bottom part of the main body frame 10. A sheet pressing plate 22 on which the sheets are placed is arranged in a cassette case 21 which configures a casing of the sheet feeding tray 2. The sheet pressing plate 22 has a pressing plate rear end portion 22*a*, which is an end portion of the rear side and is a swing center, and a pressing plate front end portion 22*b*, which is an end portion of the front side, and is supported such that the pressing plate front end portion 22*b* can be swung about the swing center in the upper-lower direction. A pressing plate urging lever 23 is arranged below the pressing plate front end portion 22*b* to urge upward the pressing plate front end portion 22*b*.

A separation pad 25 is arranged adjacent to an end portion of the front side of the cassette case 21 and at a more downstream side than the pressing plate front end portion 22*b* with respect to a sheet conveyance direction. An upper surface of the separation pad 25 is formed with a separation surface 25*a* with which a front end portion (end portion of the front side) of the sheet P, which is conveyed in the sheet conveyance direction from the inside of the cassette case 21, is brought into contact. The separation surface 25*a* is made of material such as rubber, which has a friction coefficient larger than that of the sheet. The separation pad 25 is upward urged by a separation pad urging spring 26 from the lower part.

A pinch roller 28 is arranged at an upper end portion of the front side of the cassette case 21 and at a more downstream side than the separation pad 25 with respect to the sheet conveyance direction. The pinch roller 28 is rotatably supported by the cassette case 21.

<<Developing Unit>>

A plurality of developing units 3 (black developing unit 3K, yellow developing unit 3Y, magenta developing unit 3M and cyan developing unit 3C) are aligned in parallel above the sheet feeding tray 2 in the main body frame 10. Specifically, the black developing unit 3K, the yellow developing unit 3Y, the magenta developing unit 3M and the cyan developing unit 3C are aligned in order from the front side of the color laser printer 1 toward the rear side. The yellow developing unit 3Y, the magenta developing unit 3M, the cyan developing unit 3C and the black developing unit 3K accommodate yellow, magenta, cyan and black powder toner, respectively. Each developing unit 3 is detachably mounted to the drum unit 4 such that it can be relatively moved to the drum unit obliquely along the upper-lower direction (the attaching/detaching direction and the relative moving direction will be specifically described later).

Figure 2:
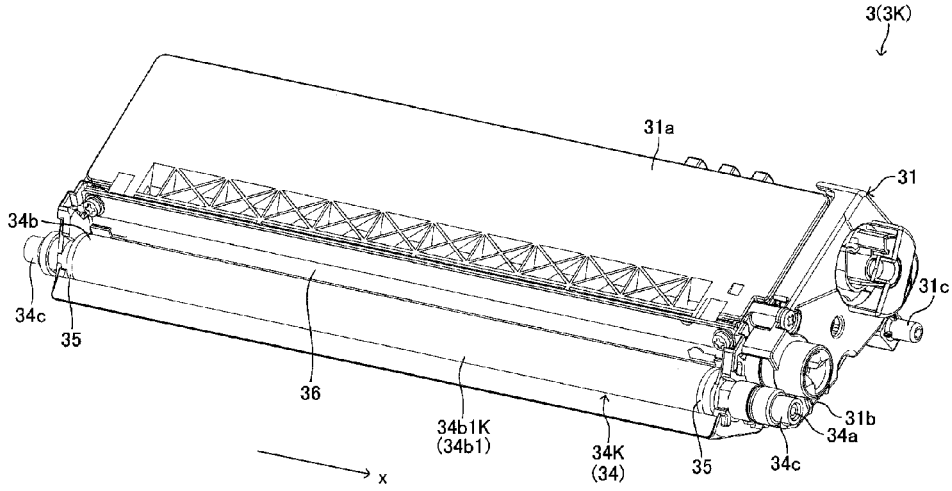
FIG. 2 is a perspective view of a developing unit (black developing unit) shown in FIG. 1.

FIG. 2 is a perspective view of the developing unit 3 (black developing unit 3K) shown in FIG. 1. The yellow developing unit 3Y, the magenta developing unit 3M and the cyan developing unit 3C have the same configuration as the black developing unit 3K, except for some portions. The specific configuration of the developing unit 3 is described with reference to FIGS. 1 and 2.

A developing unit case 31 which is a housing of the developing unit 3 has a toner box part 31*a*, a roller support part 31*b* and position relation setting protrusions 31*c*. The toner box part 31*a* has a box shape configuring a toner accommodation chamber which accommodates toner therein, and has an opening on a wall surface at a roller support part 31*b* side. In the toner accommodation chamber, an agitator 32 for agitating the toner is rotatably accommodated.

A supply roller 33 and a developing roller 34 are rotatably supported to the roller support part 31*b*. The supply roller 33 is configured by a sponge roller and is provided to contact the developing roller 34 so as to supply the toner in the toner box part 31*a* to the developing roller 34. The developing roller 34 is a rubber roller-type member which has a developing roller shaft 34*a* configured by a metal round bar and a roller main body 34*b*, which is a rubber layer formed around the developing roller shaft, and is provided to be parallel with the supply roller 33. The developing roller 34 is configured and arranged such that it is rotated in the same direction as the rotating direction (a counterclockwise direction in FIG. 1) of the supply roller 33, thereby carrying the toner carried on a toner carrying surface 34*b*1, which is a cylindrical circumferential surface of the roller main body 34*b*.

Here, in this illustrative embodiment, a black developing roller 34K, which is the developing roller 34 provided in the black developing unit 3K, is formed such that an outer diameter of the roller main body 34*b* is smaller (for example, about 0.5 mm) than those of the other developing rollers 34 for other colors. Also, the black developing unit 3K is provided with spacers 35 (an example of a gap forming member). The spacer 35 is a member having a substantially disc shape which is respectively inserted to the developing roller shaft 34*a* at outer sides of both end portions of the roller main body 34*b* in the axial direction in the black developing unit 3K and is formed to have the same outer diameter as the roller main bodies of the other developing units 3 (yellow developing unit 3Y, magenta developing unit 3M and cyan developing unit 3C). That is, the yellow developing unit 3Y, the magenta developing unit 3M and the cyan developing unit 3C are the same as the black developing unit 3K, except that the spaces 35 are not provided thereto.

As shown in FIG. 2, cylindrical shaft bearing covers 34*c* are mounted on both end portions of the developing roller shaft 34*a* and at further outer positions than the part rotatably supported by the roller support part 31*b* such that the cylindrical shaft bearing covers can be relatively rotated to the developing roller shaft 34*a*.

The developing roller 34 is arranged to expose a part of the toner carrying surface 34*b*1 (a part opposite to the part contacting the supply roller 33) to the outside of the developing unit case 31. The developing unit case 31 is mounted with a layer thickness regulation blade 36 such that the blade contacts the part of the toner carrying surface 34*b*1. The layer thickness regulation blade 36 is configured and arranged to contact the part of the toner carrying surface 34*b*1 in a counter direction, thereby regulating an amount of toner on the toner carrying surface 34*b*1.

As described above, each of the developing units 3 is configured to develop an electrostatic latent image which is formed on a photosensitive drum 41 provided to the drum unit 4 to oppose the developing unit 3, by a non-magnetic single component developing method. Particularly, in this illustrative embodiment, the black developing unit 3K, which is provided at the most upstream side with respect to the conveyance direction of the sheet P and an image is first formed therein, is configured to develop the electrostatic latent image, which is formed on the black photosensitive drum 41K, by a 'jumping developing method' by the black toner carried on the black toner carrying surface 34*b*1 at a non-contact state in which the black developing roller 34K and the black photosensitive drum 41K oppose each other with a predetermined gap therebetween.

In the meantime, the yellow developing unit 3Y, the magenta developing unit 3M and the cyan developing unit 3C are configured to develop the electrostatic latent images by a 'contact developing method' in which the toner carrying surfaces 34*b*1 contact the photosensitive drums 41, respectively. Also, the yellow developing unit 3Y, the magenta developing unit 3M and the cyan developing unit 3C are configured as the developing devices of a cleaner-less type of collecting the toner remaining on the photosensitive drums 41 to the toner carrying surfaces 34*b*1 (for example, see JP 2000-267537A).

Also, when the developing operation is not performed (i.e., when the image forming operation is not performed or when an image of a single color is formed only by the black developing unit 3K), the yellow developing unit 3Y, the magenta developing unit 3M and the cyan developing unit 3C are separated from the photosensitive drums 41. Therefore, as shown in FIG. 2, the developing unit case 31 is provided with the position relation setting protrusions 31*c* having a substantially cylindrical shape, which protrude outward from both ends of the developing unit case 31 in the width direction.

<<Drum Unit>>

Referring to FIG. 1, the drum unit 4 is provided with the plurality of the photosensitive drums 41 (the number thereof is the same as that of the developing units 3). The photosensitive drums 41 are aligned in parallel with each other and in the front-rear direction (y direction in FIG. 1). The photosensitive drums 41 are arranged to oppose the developing rollers 34 of the developing units 3, respectively.

The photosensitive drum 41 is a drum or roller-type member including a drum shaft 41*a* of a circular rod shape and a cylindrical drum main body 41*b* around the drum shaft and is configured to rotate about the drum shaft 41*a*. An electrostatic latent image carrying surface 41*b*1 (for the black photosensitive drum 41K, a electrostatic latent image carrying surface 41*b*1K for black), which is a circumferential surface of the drum main body 41*b*, is formed thereon with an electrostatic latent image in correspondence to an image to be formed and toner is carried thereon with being arranged into an image shape in correspondence to the electrostatic latent image (hereinafter, an image which is formed as the toner are arranged is referred to as a 'toner image').

A charger 42 is provided to oppose the circumferential surface of the photosensitive drum 41 at a more upstream side than the position, at which the developing roller 34 and the photosensitive drum 41 oppose each other, with respect to a rotating direction of the photosensitive drum 41 (a direction indicated by an arrow in FIG. 1: hereinafter, it is simply referred to as 'drum rotation direction'). The charger 42 is configured to uniformly charge the electrostatic latent image carrying surface 41*b*1.

A drum cleaner 43 is provided to oppose the circumferential surface of the photosensitive drum 41 at a further upstream side than the position of the black photosensitive drum 41K, at which the charger 42 and the black photosensitive drum 41K oppose each other, with respect to the drum rotation direction. That is, the drum cleaner 43 is not provided at the corresponding positions in the yellow developing unit 3Y, the magenta developing unit 3M and the cyan developing unit 3C. The drum cleaner 43 (an example of a foreign substance collection unit) is configured to clean the electrostatic latent image carrying surface 41*b*1K for black over the entire width direction (x direction in FIG. 1) which is the axial direction of the black photosensitive drum 41K, before the electrostatic latent image carrying surface for black developing is uniformly charged by the charger 42.

The photosensitive drums 41, the chargers 42 and the drum cleaner 43 are mounted to a drum unit frame 44. That is, the plurality of photosensitive drums 41 are rotatably supported to the drum unit frame 44 such that they are aligned in parallel along the front-rear direction (y direction in FIG. 1) orthogonal to the width direction (x direction in FIG. 1). The drum unit frame 44 is configured such that the developing units 3 are detachably attached thereto. That is, the drum unit frame 44 (an example of 'developing unit support frame') is configured to support the black developing unit 3K, the yellow developing unit 3Y, the magenta developing unit 3M and the cyan developing unit 3C in parallel.

The drum unit frame 44 is supported to the main body frame 10 such that it can be slid in the front-rear direction (y direction in FIG. 1). That is, the drum unit frame 44 is configured such that it can be withdrawn to the front side through the front opening 11*d* at a state where the front cover 11*e* is opened (therefore, the drum unit frame 44 can be referred to as a 'slide frame'). The detailed configuration of the drum unit frame 44 is described later.

<<Exposure Unit>>

Referring to FIG. 1, the exposure unit 5 is provided above the yellow developing unit 3Y, the magenta developing unit 3M, the cyan developing unit 3C and the black developing unit 3K. The exposure unit 5 is configured and arranged to scan laser beams (refer to the broken lines in FIG. 1), which are generated/modulated based on image data by a laser light emitting part (not shown), onto the electrostatic latent image carrying surfaces 41*b*1 uniformly charged by the chargers 42, thereby forming electrostatic latent images on the electrostatic latent image carrying surfaces 41*b*1.

<<Sheet Conveyance Unit>

The main body frame 10 is provided therein with a sheet conveyance unit 6 for feeding and conveying a sheet P toward the developing units 3 and the drum unit 4. The sheet conveyance unit 6 has a pickup roller 61, a separation roller 62, a sheet conveyance roller 63, sheet conveyance rollers 64 and a sheet guide 65.

The pickup roller 61 is rotatably supported in the main body frame 10. The pickup roller 61 is configured to rotate in a direction shown with an arrow of FIG. 1 through a driving force transfer mechanism provided in the main body frame 10. Also, the pickup roller 61 is arranged to contact the sheet P, which is urged upward by the pressing plate front end portion 22*b* of the sheet pressing plate 22 and the pressing plate urging lever 23, with predetermined pressure when forming an image.

The separation roller 62 is rotatably supported in the main body frame 10. The separation roller 62 is configured to rotate in a direction shown with an arrow of FIG. 1 through the driving force transfer mechanism provided in the main body frame 10. Also, the separation roller 62 is arranged to oppose the separation pad 25 such that a circumferential surface thereof contacts the separation pad 25 with predetermined pressure.

The sheet conveyance roller 63 is rotatably supported in the main body frame 10. The sheet conveyance roller 63 is arranged at a position closer to a conveyance destination of the sheet P than the separation roller 25 so as to oppose the pinch roller 28.

The sheet conveyance rollers 64 and the sheet guide 65 are arranged between the sheet conveyance roller 63 and the yellow image forming part (including the yellow developing unit 3Y and the photosensitive drum 41 opposing the yellow developing unit 3Y). The sheet conveyance rollers 64 and the sheet guide 65 are configured to guide and convey the sheet P having passed the sheet conveyance roller 63 toward between the yellow image forming part and the transfer unit 7 which will be described later.

<<Transfer Unit>>

The transfer unit 7 is arranged below the image forming unit (including the developing units 3 and the photosensitive drums 41 opposing the developing units) in the main body frame 10. The transfer unit 7 has a sheet conveyance belt 71, transfer rollers 72, a belt driving roller 73, a belt support roller 74 and a belt cleaner 75.

The sheet conveyance belt 71 is made of conductive plastic having conductive particles such as carbon dispersed in a synthetic resin such as polycarbonate and polyimide and is an endless belt type. The sheet conveyance belt 71 extends such that a conveyance surface 71*a*, which is an outer surface of the belt, opposes the photosensitive drums 41 of the drum unit 4.

The transfer rollers 72 are rotatably supported to oppose the respective photosensitive drums 41 with the sheet conveyance belt 71 being interposed therebetween. The transfer rollers 72 are electrically connected with output terminals of a high voltage power supply. A transfer bias voltage for transferring toner on the circumferential surfaces of the photosensitive drums 41 to the sheet P on the sheet conveyance belt 71 is applied between the transfer rollers and the photosensitive drums 41.

The belt driving roller 73 is configured to rotate in an arrow direction of FIG. 1 through a driving force transfer mechanism provided in the main body frame 10. The belt driving roller 73 is arranged at a further rearward position than the photosensitive drum 41 which oppose the cyan developing unit 3C of the developing units 3 positioned at the most rearward side.

The belt support roller 74 is arranged at a further forward position than the photosensitive drum 41 which opposes the black developing unit 3K of the developing units 3 positioned at the most forward side. The sheet conveyance belt 71 is put over and supported with predetermined tension between the belt support roller 74 and the belt driving roller 73. The belt support roller 74 is supported such that it can be rotated as the belt driving roller 73 is rotated in the direction shown with the arrow of FIG. 1 and the sheet conveyance belt 71 is correspondingly moved in the direction shown with the arrow of FIG. 1.

The belt cleaner 75 is positioned below the sheet conveyance belt 71 which extends below the respective transfer rollers 72. The belt cleaner 75 is configured to clean the conveyance surface 71*a* of the sheet conveyance belt 71 opposing the image forming unit over the entire conveyance surface in the width direction.

<<Fixing Unit>>

The fixing unit 8 is arranged at a further downstream side than the transfer unit 7 in the sheet conveyance direction in the main body frame 10. The fixing unit 8 is configured to fix the toner images, which have been formed on the sheet P, on the sheet P. The fixing unit 8 has a heating roller 81 and a pressing roller 82.

The heating roller 81 has a roller main body configured by a thin cylindrical member, which has a surface for which a mold release process is performed and is made of metal, and a halogen lamp accommodated in the roller main body. The heating roller 81 is configured to rotate in a direction shown with an arrow in FIG. 1 through a driving force transfer mechanism provided in the main body frame 10. The pressing roller 82 is a roller made of silicon rubber and is arranged such that it is pressed to the heating roller 81 with predetermined pressure. The pressing roller 82 is rotated as the heating roller 81 rotates with the sheet P being interposed between the heating roller 81 and the pressing roller, thereby fixing the toner images on the sheet P and conveying the sheet P toward the sheet discharge port 11*c*.

<<Sheet Discharge Unit>>

A sheet discharge unit 9 is provided at the most rearward side in the main body frame 10 and above the fixing unit 8. The sheet discharge unit 9 is configured to discharge the sheet P having passed through the fixing unit 8 to the outside of the main body frame 10. Specifically, the sheet discharge unit 9 has a conveyance roller 91 for a sheet for which the fixing operation is completed, a pinch roller 92, guides 93*a*, 93*b*, a sheet discharge roller 94 and a sheet discharge driven roller 95.

The conveyance roller 91 and the pinch roller 92 are arranged at a conveyance destination of the sheet P by the pressing roller 81 and the pressing roller 82. The conveyance roller 91 is configured to rotate in a direction shown with an arrow of FIG. 1. The pinch roller 92 is arranged to oppose the conveyance roller 91 and is rotatably supported such that it rotates while following the rotation of the conveyance roller 91 in a direction shown with an arrow of broken line in FIG. 1. The conveyance roller 91 and the pinch roller 92 are configured to convey the sheep P, for which the fixing operation has been completed, toward the sheet discharge port 11*c* by the rotation of the conveyance roller 91 in the direction shown with the arrow of broken line in FIG. 1.

The guides 93*a*, 93*b* are provided at a conveyance destination of the sheet P by the conveyance roller 91 and the pinch roller 92. The guides 93*a*, 93*b* are configured to guide the sheet P, which is being conveyed by the conveyance roller 91 and the pinch roller 92, toward a contact portion of the sheet discharge roller 94 and the sheet discharge driven roller 95.

The sheet discharge roller 94 and the sheet discharge driven roller 95 are arranged adjacent to the sheet discharge port 11*c* so as to oppose the sheet discharge port 11*c*. The sheet discharge roller 94 is rotatably supported such that it can be rotated in a direction shown with an arrow of FIG. 1. The sheet discharge driven roller 95 is arranged to oppose the sheet discharge roller 94. The sheet discharge driven roller 95 is rotatably supported such that it rotates while following the rotation of the sheet discharge roller 94 in the direction shown with the arrow in FIG. 1. The sheet discharge roller 94 and the sheet discharge driven roller 95 are configured to discharge the sheet P from the sheet discharge port 11*c* to the outside of the main body frame 10 by the rotation of the sheet discharge roller 94 in the direction shown with the arrow of FIG. 1.

<<Details of Drum Unit Frame>>

Figure 3:
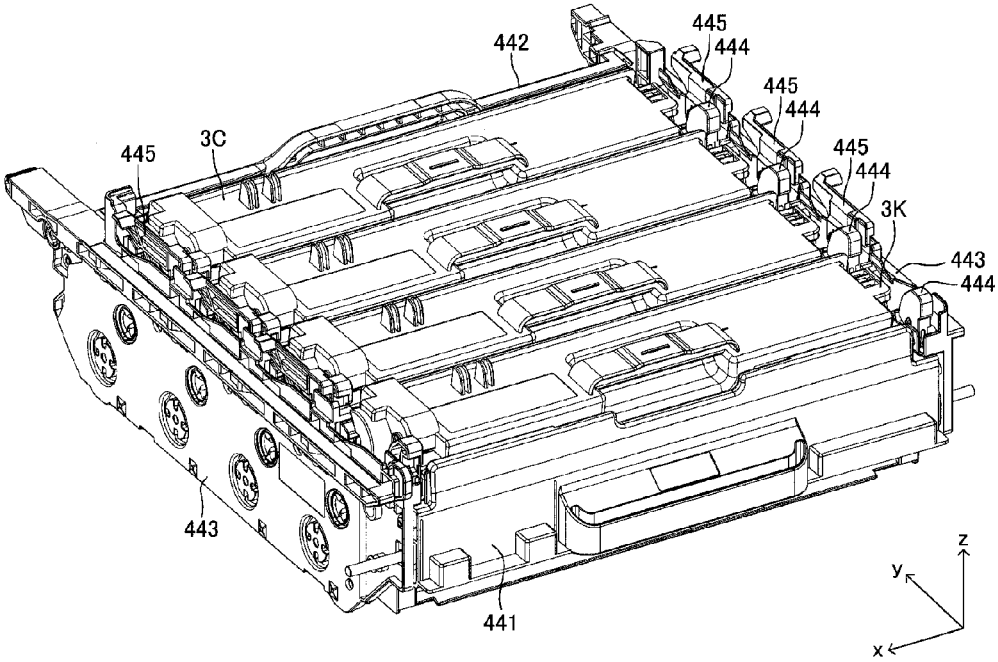
FIG. 3 is a perspective view showing a state in which a drum unit frame of FIG. 1 is mounted with developing units of respective colors.
Figure 4:
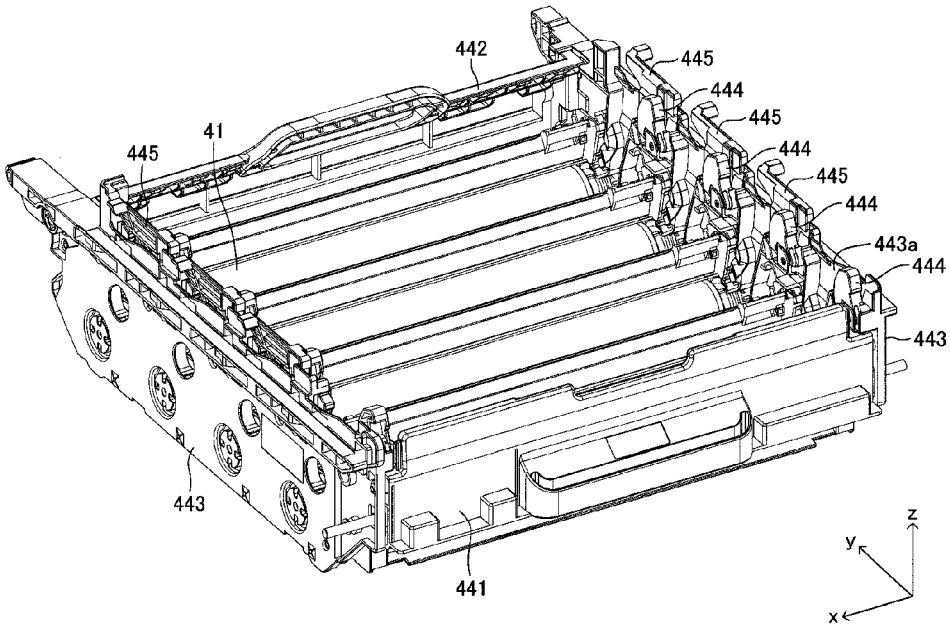
FIG. 4 is a perspective view of the drum unit frame shown in FIG. 3.
Figure 5:
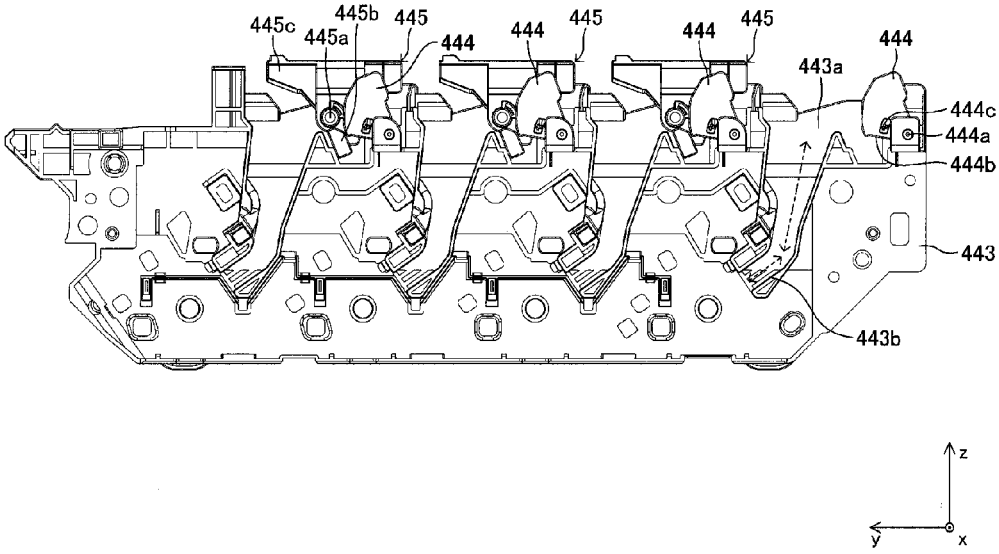
FIG. 5 is a side view of the drum unit frame shown in FIG. 4, when seen from an inner side thereof.

FIG. 3 is a perspective view showing a state in which the drum unit frame 44 shown in FIG. 1 is mounted with the developing units 3 of respective colors. FIG. 4 is a perspective view of the drum unit frame 44 shown in FIG. 3. FIG. 5 is a side view of the drum unit frame 44 shown in FIG. 4, when seen from an inner side thereof. In the below, the detailed configuration of the drum unit frame 44 is described with reference to FIGS. 3 to 5.

The drum unit frame 44 includes a front beam 441, a rear beam 442 and a pair of frame side plates 443 and has a substantially rectangular shape, when seen from a plan view. The front beam 441 is provided at a position adjacent to the black developing unit 3K in parallel with the width direction (x direction in FIG. 3). The rear beam 442 is provided at a position adjacent to the cyan developing unit 3C in parallel with the width direction. The frame side plate 443 is a plate-shaped member which is arranged to be orthogonal to the width direction, and has a length direction in the front-rear direction (y direction in FIG. 3). The photosensitive drums 41 are rotatably supported to lower end portions of the pair of frame side plates 443.

Referring to FIG. 5, inner side surfaces of the frame side plates 443 are formed with guide recesses 443*a* and swing guide recesses 443*b*, which can accommodate the shaft bearing covers 3*c* (refer to FIG. 2) of the respective developing units 3, at positions corresponding to the black developing unit 3K, the yellow developing unit 3Y, the magenta developing unit 3M and the cyan developing unit 3C.

The guide recesses 443*a* are formed at upper parts of the frame side plates 443 such that they are opened inward with respect to the width direction and are also opened upward. The guide recesses 443*a* are formed to guide the shaft bearing covers 34*c* of the developing unit 3 along a developing unit attaching/detaching direction (refer to a dashed-dotted arrow in FIG. 3) which is slightly inclined toward the front side with respect to the upper-lower direction, when attaching and detaching the developing unit 3 to and from the drum unit frame 44.

The swing guide recesses 443*b* are formed to connect to lower ends of the guide recesses 443*a*, respectively. The swing guide recesses 443*b* are formed to guide the shaft bearing covers 34*c* of the developing unit 3 along a developing roller swing direction (refer to an arrow of broken line in FIG. 5) which is a more inclined direction than the developing unit attaching/detaching direction with respect to the upper-lower direction and is also a direction connecting the rotational central axis of the developing roller 34 and the rotational central axis of the photosensitive drum 41 (under a state in which the image forming operation can be performed) in FIG. 1, when seen from a side face.

The drum unit frame 44 is configured to press the black developing unit 3K, the yellow developing unit 3Y, the magenta developing unit 3M and the cyan developing unit 3C toward the photosensitive drums 41, and to separate the black developing unit 3K, the yellow developing unit 3Y, the magenta developing unit 3M and the cyan developing unit 3C from the photosensitive drums 41 when the developing operations are not performed in the developing units.

Figure 6A:
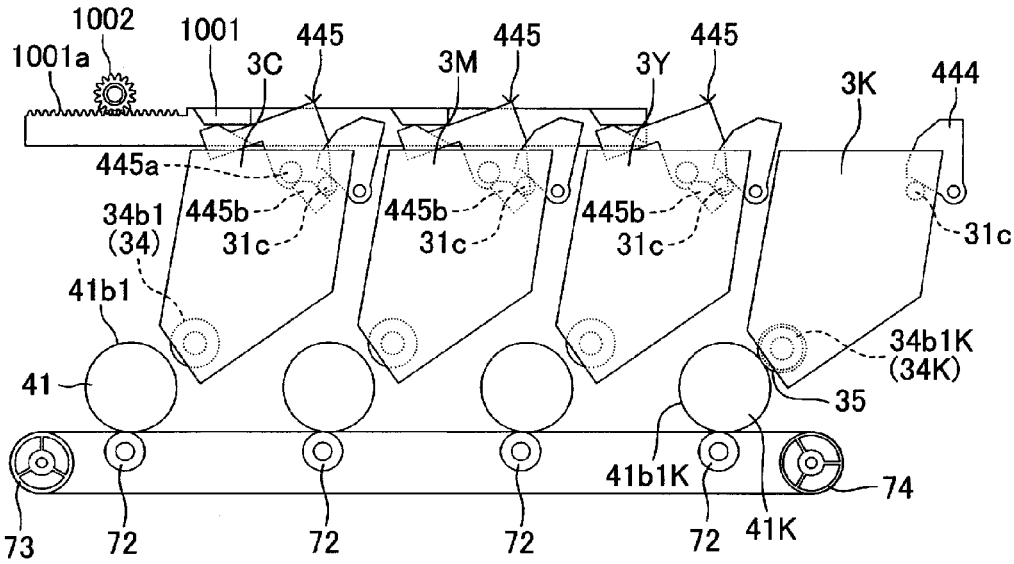
FIGS. 6A and 6B are schematic side views showing pressing and separating operations of the respective developing units shown in FIG. 1 with respect to photosensitive drums.
Figure 6B:
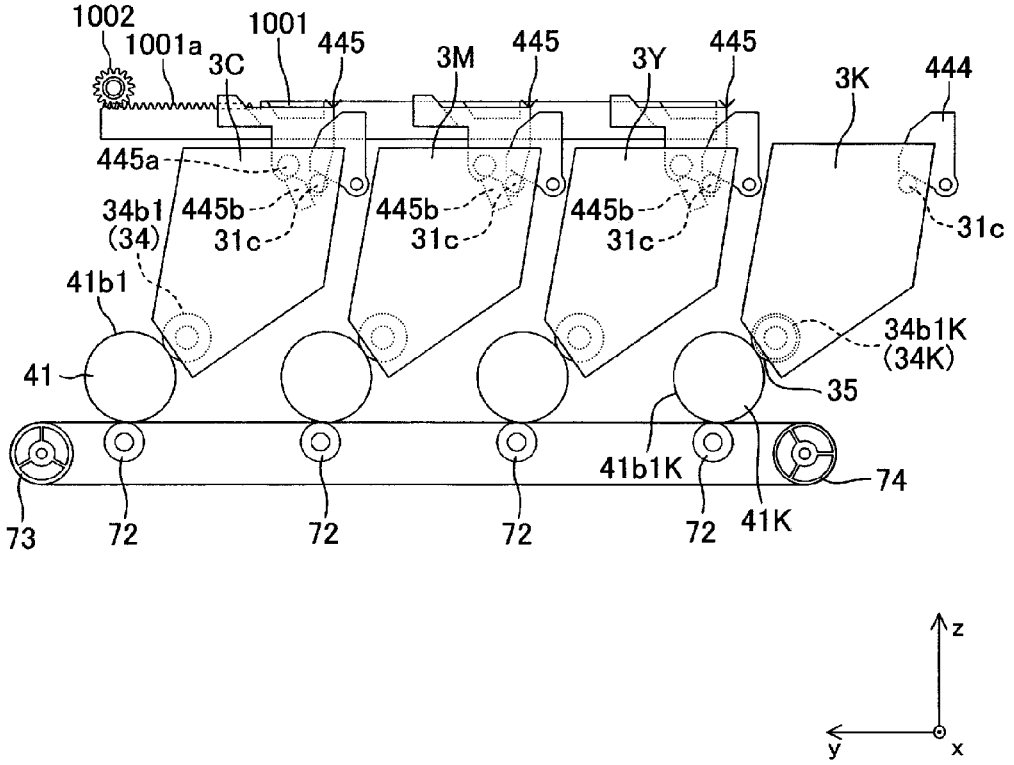

FIGS. 6A and 6B are schematic side views showing pressing and separating operations of the respective developing units 3 shown in FIG. 1 with respect to photosensitive drums 41. In the below, the configuration for pressing and separating the respective developing units 3 to and from the photosensitive drums 41 is described with reference to FIGS. 5, 6A and 6B.

Pressing members 444 for pressing the developing unit cases 31 (refer to FIG. 2) toward the photosensitive drums 41 are provided at positions above the respective position relation setting protrusions 31*c* at the state in which the black developing unit 3K, the yellow developing unit 3Y, the magenta developing unit 3M and the cyan developing unit 3C are mounted to the drum unit frame 44. That is, the pressing members 444 are provided at the positions corresponding to the black developing unit 3K, the yellow developing unit 3Y, the magenta developing unit 3M and the cyan developing unit 3C.

The pressing member 444 is configured such that a swing support shaft 444*a*, which is a rotational central shaft (swing central shaft) parallel with the width direction, is rotatably supported by the frame side plate 443. That is, the pressing member 444 is mounted to the frame side plate 443 such that a contact part 444*b* opposing the position relation setting protrusion 31*c* swings in the upper-lower direction.

Also, the pressing member 444 is always urged downward by a spring 444*c* mounted to the swing support shaft 444*a* such that the contact part 444*b* presses the position relation setting protrusion 31*c* downward while contacting the position relation setting protrusion 31*c*.

Separating members 445 are respectively provided at positions opposing the respective pressing members 444 with the respective position relation setting protrusions 31*c* being interposed therebetween at the state in which the yellow developing unit 3Y, the magenta developing unit 3M and the cyan developing unit 3C are mounted. That is, the separating members 445 are provided at the positions corresponding to the yellow developing unit 3Y, the magenta developing unit 3M and the cyan developing unit 3C, except for the black developing unit 3K of the plurality of developing units 3.

The separating member 445 is configured such that a swing support shaft 445*a* is rotatably supported by the frame side plate 443 and thus a contact part 445*b* opposing the position relation setting protrusion 31*c* obliquely swings in the upper-lower direction. The contact part 445*b* and an operation part 445*c* located at an opposite position thereto with the swing support shaft 445*a* being interposed therebetween are operated by a translation cam 1001 shown in FIGS. 6A and 6B, so that a swing state of the separating member 445 is changed.

As shown in FIGS. 6A and 6B, the translation cam 1001 is a rod-shaped member which is provided along the front-rear direction which is an arrangement direction of the black developing unit 3K, the yellow developing unit 3Y, the magenta developing unit 3M and the cyan developing unit 3C, and is moved along the front-rear direction to control the swing state of the separating members 445. In this illustrative embodiment, the translation cam 1001 is slidably supported to the main body frame 10. One end portion of the translation cam 1001 in the length direction is formed with a rack gear 1001*a*. That is, the translation cam 1001 can be moved in the front-rear direction as a pinion gear 1002 to be meshed with the rack gear 1001 is rotated.

<Image Forming Operation>

In the below, the image forming operation by the color laser printer 1 of this illustrative embodiment is described together with the operations and effects by the configuration of this illustrative embodiment.

When the pickup roller 61 is rotated in the direction shown with the arrow in FIG. 1, the sheet P placed in the cassette case 21 is picked up toward the separation roller 62. Then, a leading end of the sheet P is conveyed to a position between the separation roller 62 and the separation pad 25. As the separation roller 62 is rotated in the direction shown with the arrow of FIG. 1, only the uppermost sheet P is conveyed toward the sheet conveyance roller 63.

The sheet P having passed through the sheet conveyance roller 63 passes to the sheet conveyance rollers 64 and the sheet guide 65 and is then conveyed toward the image forming part in which the transfer unit 7 and the drum unit 4 oppose each other (normally, before the sheet reaches the position at which the transfer unit 7 and the drum unit 4 oppose each other, specifically, the position at which the sheet conveyance roller 63 and the pinch roller 28 oppose each other, the paper dusts attached on the sheet P are appropriately removed by the sheet conveyance rollers 64).

When the leading end of the sheet P reaches the sheet conveyance belt 71, the sheet P is conveyed substantially horizontally toward the fixing unit 8 at the rear side with the sheet P being carried on the conveyance surface 71*a* of the sheet conveyance belt 71. While the sheep P is conveyed to the positions opposing the photosensitive drums 41, the toner images are carried on the electrostatic latent image carrying surface 41*b*1.

As the agitators 32 are rotated, the toner in the developing unit cases 31 are agitated and supplied toward the developing rollers 33. The toner supplied to the supply rollers 33 are sent to the developing rollers 34 by the rotations of the supply rollers 33 in the direction shown with the arrow in FIG. 1. Then, the toner are friction-charged at the contact positions of the developing rollers 34 and the supply rollers 33, so that the toner are carried on the toner carrying surfaces 34*b*1, which are the circumferential surfaces of the developing rollers 34. The toner carried on the toner carrying surfaces 34*b*1 are regulated to have predetermined density and amount of charges by the layer thickness regulation blades 36, and then sent to the developing positions, at which the developing rollers 34 and the photosensitive drums 41 oppose each other, by the rotations of the developing rollers 34 in the direction shown with the arrow in FIG. 1.

The electrostatic latent image carrying surfaces 41*b*1, which are the circumferential surfaces of the photosensitive drums 41, are uniformly charged by the chargers 42 and then the laser lights corresponding to image information are scanned thereto by the exposure unit 5. Thereby, electrostatic latent images corresponding to the image information are formed on the electrostatic latent image carrying surfaces 41*b*1. When the electrostatic latent image carrying surfaces 41*b*1 having the electrostatic latent images formed thereon and the toner carrying surfaces 34*b*1 having the toner of the predetermined density and amount of charges attached thereon oppose each other, the electrostatic latent images on the electrostatic latent image carrying surfaces 41*b*1 are developed by the toner. That is, the toner images are carried on the electrostatic latent image carrying surfaces 41*b*1.

Here, in the black developing unit 3K which is located at the most upstream side with respect to the sheet conveyance direction (the direction in which the conveyance surface 71*a* of the sheet conveyance belt 71 at the position opposing the drum unit 4 moves toward just below the photosensitive drums 41 with the sheet P being carried on the conveyance surface), a predetermined gap is formed between the black developing roller 34K (black toner carrying surface 34*b*1K) and the black photosensitive drum 41K (electrostatic latent image carrying surface 41*b*1K for black) by the spacers 35. At the state in which the black developing roller 34K and the black photosensitive drum 41K do not contact each other, the electrostatic latent image on the electrostatic latent image carrying surface 41*b*1K is developed by the black toner (jumping developing).

As described above, in this illustrative embodiment, the non-contact jumping developing is performed by the black developing unit 3K which is located at the most upstream side in the sheet conveyance direction and is most frequently used. Thereby, the deterioration (including the introduction of the paper dusts into the black developing unit 3K) of the black toner due to the continuous using is favorably suppressed.

Meanwhile, in the yellow developing unit 3Y, the magenta developing unit 3M and the cyan developing unit 3C, which are located at the more downstream positions than the black developing unit 3K, at the state in which the developing rollers 34 (toner carrying surfaces 34*b*1) and the photosensitive drums 41 (electrostatic latent image carrying surfaces 41*b*1) contact each other, the electrostatic latent images on the electrostatic latent image carrying surfaces 41*b*1 are developed by the respective color toner (contact developing).

At the position at which the sheet opposes the photosensitive drums 41 (electrostatic latent image carrying surfaces 41*b*1), the toner images on the electrostatic latent image carrying surfaces 41*b*1 are transferred onto the sheep P by the transfer bias between the transfer rollers 72 and the photosensitive drums 41. After the transfer to the sheet P, the black toner remaining on the electrostatic latent image carrying surface 41*b*1K for black and the foreign substances such as paper dusts and the like, which are moved from the sheet P to the electrostatic latent image carrying surface 41*b*1K for black and are thus attached to the electrostatic latent image carrying surface 41*b*1K for black when transferring the toner image, are removed by the drum cleaner 43.

After the transfer to the sheet P, the yellow toner remaining on the electrostatic latent image carrying surface 41*b*1 are uniformly charged by the charger 42 and then moved to the toner carrying surface 34*b*1 by the contact between the developing roller 34 and the photosensitive drum 41 in the yellow developing unit 3Y, so that they are favorably collected (cleaner-less collection). Similarly, after the transfer to the sheet P, the magenta toner remaining on the electrostatic latent image carrying surface 41*b*1 are favorably collected by the developing roller 34 in the magenta developing unit 3M, and the cyan toner remaining on the electrostatic latent image carrying surface 41*b*1 after the transfer to the sheet P are also favorably collected by the developing roller 34 in the cyan developing unit 3C.

Here, the sheet P having passed through the black photosensitive drum 41K has little paper dusts attached (that is, even when the paper dusts remain on the sheet P conveyed to the position at which the sheet opposes the black photosensitive drum 41K, the transfer bias and the like is applied at the position at which the sheet opposes the black photosensitive drum 41K, so that most of the paper dusts are moved to the black photosensitive drum 41K). Therefore, the so-called 'cleaner-less collection' is favorably performed in the yellow developing unit 3Y, the magenta developing unit 3M and the cyan developing unit 3C without the negative influence of the paper dusts.

The sheet P having passed the transfer unit 7 and having the toner images attached thereon is conveyed to the fixing unit 8. The sheet P is held and heated between the heating roller 81 and the pressing roller 82, so that the toner on the sheet P are melted and fixed on the surface thereof. Then, the sheet P is discharged toward the sheet discharge tray 11*b* by the sheet discharge rollers 94.

<Separating/Pressing Operation>

When the image forming operation is not performed, and when an image of a single color is formed by the black developing unit 3K, the separating members 445 are operated by the translation cam 1001 such that the contact parts 445*b* are swung obliquely upward, as shown in FIG. 6A. Then, the position relation setting protrusions 31*c* of the yellow developing unit 3Y, the magenta developing unit 3M and the cyan developing unit 3C are moved obliquely upward against the downward pressing by the pressing members 444.

Thereby, the developing rollers 34 of the yellow developing unit 3Y, the magenta developing unit 3M and the cyan developing unit 3C are moved obliquely upward along the developing roller swing direction (refer to the arrow of broken line in FIG. 5), so that the toner carrying surfaces 34*b*1 in the yellow developing unit 3Y, the magenta developing unit 3M and the cyan developing unit 3C are separated from the photosensitive drums 41 (electrostatic latent image carrying surfaces 41*b*1).

On the other hand, when an image of multi-colors is formed, the separating members 445 are operated by the translation cam 1001 such that the contact parts 445*b* are swung obliquely downward, as shown in FIG. 6B. Then, the position relation setting protrusions 31*c* of the yellow developing unit 3Y, the magenta developing unit 3M and the cyan developing unit 3C are moved obliquely downward by the downward pressing of the pressing members 444.

Thereby, the developing rollers 34 of the yellow developing unit 3Y, the magenta developing unit 3M and the cyan developing unit 3C are moved obliquely downward along the developing roller swing direction (refer to the arrow of broken line in FIG. 5), so that the toner carrying surfaces 34*b*1 in the yellow developing unit 3Y, the magenta developing unit 3M and the cyan developing unit 3C are brought into contact with the photosensitive drums 41 (electrostatic latent image carrying surfaces 41*b*1), respectively.

In the configuration of this illustrative embodiment, the contacts of the developing rollers 34 in the yellow developing unit 3Y, the magenta developing unit 3M and the cyan developing unit 3C to the photosensitive drums 41 by the predetermined pressing force and the gap maintenance between the developing roller 34 in the black developing unit 3K and the photosensitive drum 41 are favorably realized by the same configuration. Also, the separating operation in the developing rollers 34 in the yellow developing unit 3Y, the magenta developing unit 3M and the cyan developing unit 3C when the corresponding developing units are not used is realized by the simple apparatus configuration.

Modified Illustrative Embodiments

In the meantime, the above illustrative embodiment simply exemplifies the representative illustrative embodiment which the applicant thought as a preferred embodiment at the time of the filing of the application. Therefore, the present invention is not limited to the above illustrative embodiment. Thus, it is possible to variously change the above illustrative embodiment without changing the gist of the present invention.

In the below, representative modified illustrative embodiments are exemplified. In the below description of the modified illustrative embodiments, the members having the same configurations and functions as the above illustrative embodiment are indicated with the same reference numerals as the above illustrative embodiment. Regarding the descriptions of the corresponding members, the above descriptions in the above illustrative embodiment are used within a range in which there is no technical contradiction.

The separating member 445 may be provided at a position corresponding to the black developing unit 3K. That is, the developing unit 3 of the 'jumping developing type' may be configured to be separated from the photosensitive drum 41 when it is not used.

When the black developing unit 3K is provided at the most downstream side and the yellow developing unit 3Y is provided at the most upstream side, the spacers 35 are provided to the yellow developing unit 3Y. That is, the yellow developing unit 3Y is configured as the 'jumping developing type'. Alternatively, in this case, the spacers 35 may be also provided to the black developing unit 3K.

Instead of the sheet conveyance belt 71 of the above illustrative embodiment, an intermediate transfer belt or photosensitive belt capable of carrying a toner image thereon may be used. In this case, the drum unit frame 44 shown in FIG. 3 is configured to rotatably support the transfer rollers 72, the belt driving roller 73 and the belt support roller 74, rather than the photosensitive drums 41, and the belt is provided to extend over the rollers.

What is claimed is:

1. An image forming apparatus configured to form an image with developer of a plurality of colors on a sheet-type recording medium by a non-magnetic single component developing method, the image forming apparatus comprising:

a first color developing unit which is configured to perform developing of a first color by a jumping developing method before performing developing of a second color;

a second color developing unit which is configured to perform developing of the second color by a contact developing method after performing the developing of the first color by the first color developing unit, wherein the second color developing unit includes a plurality of second color developing units, and wherein the first color developing unit and the plurality of second color developing units are provided in parallel with each other;

a developing unit support frame which supports the first color developing unit and the plurality of second color developing units in parallel with each other, wherein the first color developing unit includes:

a first color electrostatic latent image carrying member;

a first color developer carrying member configured to carry developer of the first color, wherein the first color developer carrying member is arranged to oppose the first color electrostatic latent image carrying member with a predetermined gap therebetween;

a first color developing unit case which rotatably supports the first color developer carrying member and accommodates therein developer of the first color;

a first color developing unit case pressing part which is provided to press the first color developing unit case toward the first color electrostatic latent image carrying member; and a gap forming member which is provided at a position corresponding to an axial end portion of the first color developer carrying member so as to form the predetermined gap between the first color developer carrying surface and the first color electrostatic latent image carrying member, wherein each of the second color developing units includes:

a second color electrostatic latent image carrying member;

a second color developer carrying member configured to carry developer of the second color, wherein the second color developer carrying member is arranged to contact the second color electrostatic latent image carrying member;

a second color developing unit case which rotatably supports the second color developer carrying member and accommodates therein developer of the second color; and a second color developing unit case pressing part which is provided to press the second color developing unit case toward the second color electrostatic latent image carrying member, wherein the developing unit support frame rotatably supports the first color electrostatic latent image carrying member and the second color electrostatic latent image carrying members, respectively, wherein the first color developing unit case and the second color developing unit cases are detachably attached to the developing unit support frame, and wherein the first color developing unit case pressing part and the second color developing unit case pressing parts are provided to the developing unit support frame.

2. The image forming apparatus according to claim 1, wherein the first color is a black.

3. The image forming apparatus according to claim 1, wherein the second color developing unit includes a second color developer carrying member which has a second color developer carrying surface that is a cylindrical circumferential surface and configured to carry developer, wherein the second color developing unit is arranged to oppose an electrostatic latent image carrying member such that an electrostatic latent image on the electrostatic latent image carrying member is developed by developer while the second color developer carrying surface contacting the electrostatic latent image carrying member, and wherein the second color developing unit is configured to collect remaining developer which remains on the electrostatic latent image carrying member, by the second color developer carrying member.

4. The image forming apparatus according to claim 1, further comprising:

a translation cam which is a rod-shaped member provided along an arrangement direction of the second color developing units and is configured to move the second color developing unit cases in an opposite direction to a pressing direction of the second color developing unit case pressing parts to separate the second color electrostatic latent image carrying members and the second color developer carrying members, respectively when an image is not formed, and is configured to release the separated state when forming an image.

5. The image forming apparatus according to claim 1, further comprising:

a foreign substance collection unit which is configured to collect foreign substances which are different from developer and are attached on the first color electrostatic latent image carrying member.

6. An image forming apparatus configured to form an image with developer of a plurality of colors on a sheet-type recording medium by a non-magnetic single component developing method, the image forming apparatus comprising:

a first color developing unit which is configured to perform developing of black by a jumping developing method;

a second color developing unit which is configured to perform developing of a second color by a contact developing method, wherein the second color developing unit includes a plurality of second color developing units, and wherein the first color developing unit and the plurality of second color developing units are provided in parallel with each other;

a developing unit support frame which supports the first color developing unit and the plurality of second color developing units in parallel with each other, wherein the first color developing unit includes:

a first color electrostatic latent image carrying member;

a first color developer carrying member configured to carry developer of the first color, wherein the first color developer carrying member is arranged to oppose the first color electrostatic latent image carrying member with a predetermined gap therebetween;

a first color developing unit case which rotatably supports the first color developer carrying member and accommodates therein developer of the first color;

a first color developing unit case pressing part which is provided to press the first color developing unit case toward the first color electrostatic latent image carrying member; and a gap forming member which is provided at a position corresponding to an axial end portion of the first color developer carrying member so as to form the predetermined gap between the first color developer carrying surface and the first color electrostatic latent image carrying member, wherein each of the second color developing units includes:

a second color electrostatic latent image carrying member;

a second color developer carrying member configured to carry developer of the second color, wherein the second color developer carrying member is arranged to contact the second color electrostatic latent image carrying member;

a second color developing unit case which rotatably supports the second color developer carrying member and accommodates therein developer of the second color; and a second color developing unit case pressing part which is provided to press the second color developing unit case toward the second color electrostatic latent image carrying member, wherein the developing unit support frame rotatably supports the first color electrostatic latent image carrying member and the second color electrostatic latent image carrying members, respectively, wherein the first color developing unit case and the second color developing unit cases are detachably attached to the developing unit support frame, and wherein the first color developing unit case pressing part and the second color developing unit case pressing parts are provided to the developing unit support frame.

7. The image forming apparatus according to claim 6, wherein the second color developing unit includes a second color developer carrying member which has a second color developer carrying surface that is a cylindrical circumferential surface and configured to carry developer, wherein the second color developing unit is arranged to oppose an electrostatic latent image carrying member such that an electrostatic latent image on the electrostatic latent image carrying member is developed by developer while the second color developer carrying surface contacting the electrostatic latent image carrying member, and wherein the second color developing unit is configured to collect transfer remaining developer which remains on the electrostatic latent image carrying member, by the second color developer carrying member.

8. The image forming apparatus according to claim 6, further comprising:

a translation cam which is a rod-shaped member provided along an arrangement direction of the second color developing units and is configured to move the second color developing unit cases in an opposite direction to a pressing direction of the second color developing unit case pressing parts to separate the second color electrostatic latent image carrying members and the second color developer carrying members, respectively when an image is not formed, and is configured to release the separated state when forming an image.

9. The image forming apparatus according to claim 6, further comprising:

a foreign substance collection unit which is configured to collect foreign substances which are different from developer and are attached on the first color electrostatic latent image carrying member.

* * * * *